US008461781B2

(12) United States Patent
Schenk et al.

(10) Patent No.: US 8,461,781 B2
(45) Date of Patent: Jun. 11, 2013

(54) CONFIGURATION OF A LUMINAIRE SYSTEM

(75) Inventors: Tim Corneel Wilhelmus Schenk, Eindhoven (NL); Peter Deixler, Eindhoven (NL); Lorenzo Feri, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 341 days.

(21) Appl. No.: 12/919,252

(22) PCT Filed: Mar. 9, 2009

(86) PCT No.: PCT/IB2009/050956

§ 371 (c)(1),
(2), (4) Date: Jan. 18, 2011

(87) PCT Pub. No.: WO2009/112996

PCT Pub. Date: Sep. 17, 2009

(65) Prior Publication Data

US 2011/0101871 A1 May 5, 2011

(30) Foreign Application Priority Data

Mar. 12, 2008 (EP) ..... 08152617

(51) Int. Cl.
*H05B 37/00* (2006.01)

(52) U.S. Cl.
USPC ..... 315/318; 315/312; 315/362; 315/149; 315/158

(58) Field of Classification Search
USPC ..... 315/312, 292, 294, 297, 307, 316–318, 315/362, 149, 158
See application file for complete search history.

(56) References Cited

U.S. PATENT DOCUMENTS

| | | | | |
|---|---|---|---|---|
| 6,548,967 | B1 | 4/2003 | Dowling et al. | |
| 6,777,891 | B2 * | 8/2004 | Lys et al. | 315/291 |
| 2002/0043938 | A1 | 4/2002 | Lys | |
| 2004/0105264 | A1 | 6/2004 | Spero | |
| 2006/0273741 | A1 | 12/2006 | Stalker, III | |
| 2007/0291483 | A1 | 12/2007 | Lys | |
| 2011/0137757 | A1 * | 6/2011 | Paolini et al. | 705/27.1 |

FOREIGN PATENT DOCUMENTS

| | | | |
|---|---|---|---|
| WO | 2005012997 | A2 | 2/2005 |
| WO | 2007010470 | A1 | 1/2007 |

* cited by examiner

*Primary Examiner* — Haiss Philogene
(74) *Attorney, Agent, or Firm* — Mark L. Beloboradov

(57) ABSTRACT

There is provided a method for advanced configuration and initialization of a luminaire system. The luminaire system comprises one or more lighting devices (102), an apparatus (104) and a user interface (106). The apparatus comprises a light sensor. One or more of the lighting devices are not connected to a central controller by means of a wired/wireless connection. Therefore, techniques and procedures to use manual interaction by an operator (114) to control these lighting devices are proposed. The proposed techniques enable backward compatible and low-cost implementations of advanced luminaire initialization and configuration. Moreover, this invention proposes to combine the user input, sensing and control functionality into one device, thereby reducing the total cost of implementation and ownership of the proposed system. A corresponding system and apparatus are also presented.

14 Claims, 4 Drawing Sheets

CONFIGURATION OF A LUMINAIRE SYSTEM

FIELD OF THE INVENTION

The invention relates to the field of luminaire systems, more specifically to a method of configuring a luminaire system, a system, an apparatus and a computer program product thereof.

BACKGROUND OF THE INVENTION

Many lighting systems require configuration in order to produce a satisfactory illumination environment. Examples of such environments include office spaces, private homes, public outdoor spaces, theatres or other entertainment venues, retail premises and the like. It is often a cumbersome process to determine the lighting conditions for such environments, especially if the lighting system comprises a plurality of different light sources. Therefore these types of tasks often require many man hours.

The U.S. patent application 2002/0043938 discloses a system and method for setting addresses and is directed towards a system for setting addresses by communicating a unique identifier from a network device to a remote receiver, communicating the unique identifier from the remote receiver to a controller, generating a network address, and communicating the network address from the controller to the network device from which the unique identifier was originally communicated. The reference thus teaches of a system and method for configuring network devices by associating the network devices with network addresses.

SUMMARY OF THE INVENTION

A number of disadvantages of the cited art has been identified in light of the present invention. As stated above the U.S. patent application 2002/0043938 discloses a system and method for receiving identification information for setting addresses. However the method is dependent on setting up a dedicated and traditional communications channel between the device and the controller. Utilizing such traditional communications hence requires a dedicated transmitter at the device-side and a dedicated receiver at the controller-side, wherein the transmitter and receiver comprise either antennas suitable for wireless communications or sockets suitable for wired communications.

Thus both complexity and maintenance costs for the system are increased by including the above means for communication. Wireless communication, such as radio communication, has the added disadvantage of negatively effect other radio-based equipment used in the environment in which the lighting system is to be installed. Wireless communication is also known to be error-prone. Wired communication has the added disadvantage of requiring ungainly cables between each one of the devices and the controller. These cables also need to be suitably positioned. Cables also cause extra costs for the system.

In view of the above, an objective of the invention is to solve or at least reduce the problems discussed above. One object is to provide initialization and configuration of a lighting system. Generally, the above objectives are achieved by the attached patent claims.

According to a first aspect of the present invention there is thus provided a method of configuring a luminaire system, wherein the luminaire system comprises at least one lighting device, an apparatus and a user interface, wherein the apparatus comprises a light sensor, and wherein the method comprising the steps of: receiving, by the light sensor, light from the at least one lighting device, wherein the light comprises lighting data; identifying the at least one lighting device based on the lighting data; determining lighting settings for the at least one identified lighting device; presenting, via the user interface, information pertaining to the determined lighting settings; and manually adjusting the at least one identified lighting device based on the presented information.

Hence such a method enables for advanced and low-cost initialization and configuration of a non-networked lighting system based on manual interaction in order to overcome the disadvantages as identified above. The lighting devices are thus controlled by a manual action of an operator and neither wired nor wireless links between the sensor-side and the lighting device-side are required for controlling the configuration. As such it enables low-cost and backward compatible operation with systems based on configuration methods utilizing either wired or wireless links.

The method may further comprise the step of calculating a difference between the lighting data and target lighting data for the at least one identified lighting device; and the determining of lighting settings may be based on this difference.

The method thus allows for both the option of determining lighting settings for the lighting devices based on default values and the option of determining lighting settings based on the received and measured lighting conditions for each individual lighting device in the system.

The step of manually adjusting the at least one identified lighting device may be performed by manually adjusting at least one actuator of the at least one identified lighting device.

Thus such an actuator, which may be defined by one or more DIP-switches (Dual In-line Package), a keypad, or by reading settings stored on an electrical or mechanical component, such as a programmable memory, which is inserted into the lighting device, allows for an operator to provide the at least one lighting device with new settings in an easy and user-friendly manner.

The user interface may be comprised in the apparatus.

This embodiment has the advantage of providing one single device for determining new settings for the at least one lighting device and presenting information pertaining to the settings on a user interface comprised in the same device, thereby reducing the number of devices needed to configure a lighting system The luminaire system may further comprise an external computer, wherein the external computer comprises the user interface, and wherein the method further comprises the step of sending the lighting data from the apparatus to the external computer; and wherein the identifying, the calculating, the determining and the presenting are performed by the external computer.

Thus having an external computer yields the added advantage of providing a method in which an external and power computing unit may be used. The external computer, preferably a laptop computer or a personal digital assistant (PDA), may thus be brought by the operator to the premises of installation and configuration. When the configuration is completed the external computer may be removed, thus reducing the overall complexity of the installed lighting system.

The method may further comprise the step of transmitting information pertaining to the determined lighting settings from the apparatus to the at least one identified lighting device by one from the group of a wireless transmission and a wired transmission.

Hence such a method allows for scenarios in which both lighting devices with and without wired/wireless communications capabilities coexist in the same lighting system. In such a scenario the apparatus may thus also be equipped with wired/wireless communications capabilities. As such it will control the lighting devices operatively connected to the apparatus via wired/wireless links and the other lighting devices via the manual interaction as described above, thus enabling both backward compatible and low-cost implementations of advanced luminaire initialization and configuration.

The lighting data may comprise a lighting device identification code.

Utilizing such an identification code thus provides the added benefit of providing means for uniquely identifying each individual lighting device in the lighting system. Having the lighting device identification code embedded in the emitted light provides the additional advantage that separate means for identification, such as network addresses or the like, or transmitting/receiving the identity, such as an antennas or network sockets are not necessary.

The lighting settings may pertain to at least one from the group of colour, colour temperature, intensity.

Thus the proposed method allows for identifying and measuring a number of light properties.

The steps of receiving light, identifying at least one lighting device, determining lighting settings, presenting information and manually adjusting the at least one lighting device may be performed during at least a first configuration iteration and a second configuration iteration.

Hence the proposed steps for configuring of a lighting systems may be repeated if necessary. This embodiment may be preferred for large-scale large-complexity lighting systems, which may require more than one configuration iteration before new lighting conditions are obtained. The here proposed multiple iterations might be required due to limited accuracy in sensing or due to limited resolution in the manual transfer of the data. It might for example not be possible transfer a 64-bit value to the luminary using a DIP switch interface. A procedure could for instance be that in a first step the most significant bits of the intensity are controlled set and in following step the next set of bits, until in the final iteration the least significant bits are controlled.

According to a second aspect of the present invention there is provided a luminaire system comprising at least one lighting device, an apparatus and a user interface, wherein the apparatus comprises a light sensor, and wherein light from the at least one lighting device is received by the light sensor, wherein the light comprises lighting data; the at least one lighting device is identified based on the received lighting data; lighting settings for the at least one identified lighting device are determined; information pertaining to the determined lighting settings is presented via the user interface; and the at least one identified lighting device is manually adjusted based on the presented information.

Hence the method of configuring a luminaire system may be realized in such a lighting system.

The luminaire system may further comprise an external computer, wherein the external computer comprises a controller, and wherein the calculating and the determining are performed by the controller of the external computer; and the user interface is comprised in said computer. The apparatus may further comprise a further user interface, and wherein information pertaining to the determined lighting settings is presented by the further user interface.

At least one of said at least one lighting device may comprise a receiver and the apparatus may further comprise a transmitter, and information pertaining to the determined lighting settings may be transmitted by the transmitter to the receiver(s) by one from the group of a wireless transmission and a wired transmission. Alternatively the at least one lighting device may not comprise any communication means for automatically receiving determined lighting settings.

According to a third aspect of the present invention there is provided an apparatus for configuration of a luminaire system, wherein the apparatus comprises a light sensor and a controller, and wherein light from at least one lighting device is received by the light sensor, wherein the light comprising lighting data; the at least one lighting device is identified by the controller based on the received lighting data; lighting settings for the at least one identified lighting device are determined by the controller; and information pertaining to the determined lighting settings is transmitted to a user interface.

Hence the method of configuring a luminaire system may be realized by utilizing such an apparatus.

The apparatus may further comprise the user interface, and the information may be presented via the user interface.

A difference between the received lighting data and target lighting data for the at least one identified lighting device may be calculated by the controller; and the lighting settings may be based on the difference.

The apparatus may further comprise a transmitter and information pertaining to the determined lighting settings may be transmitted by the transmitter to at least one of the at least one lighting device by one from the group of a wireless transmission and a wired transmission.

According to a fourth aspect of the present invention there is provided a computer program product, comprising computer program code which is stored on a computer-readable storage medium and which, when executed on a processor, carries out the method according to any one of the embodiments described above.

Thus such a computer program product enables for the proposed method to be downloaded, installed, and run on an external computer, such as a laptop computer or a personal digital assistant.

These and other aspect of the invention will be apparent from and elucidated with reference to the embodiments described hereinafter.

Generally, all terms used in the claims are to be interpreted according to their ordinary meaning in the technical field, unless explicitly defined otherwise herein. All references to "a/an/the/said [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

Other features and advantages of the present invention will become apparent from the following detailed description of a presently preferred embodiment, with reference to the accompanying drawings, in which:

FIG. 2(*c*) shows an actuator according to an embodiment;

FIG. 2(*d*)-(*f*) show an apparatus according to embodiments;

DETAILED DESCRIPTION OF EMBODIMENTS

Figure 1A:
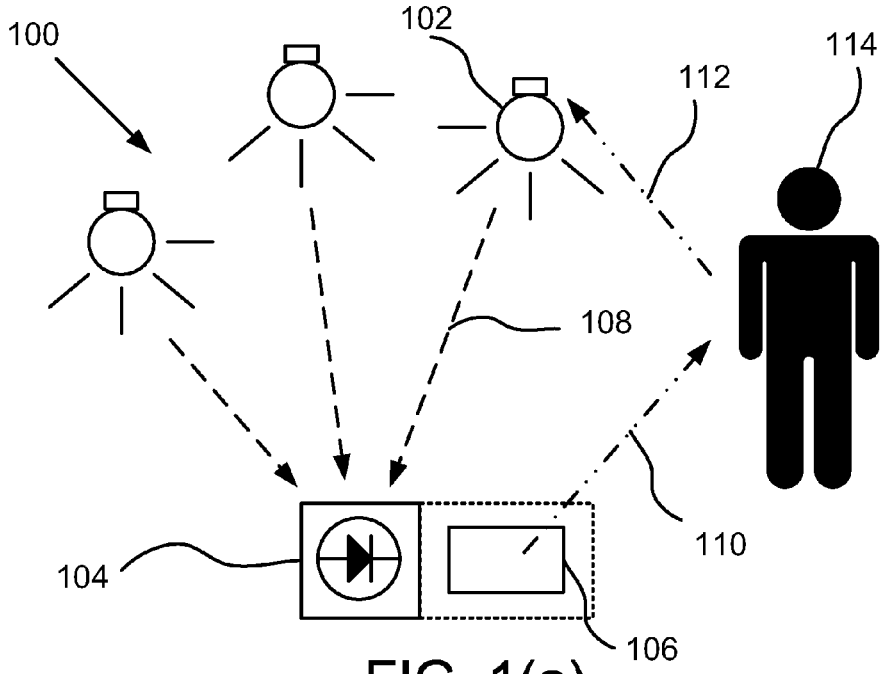
FIG. 1(*a*)-(*d*) show a luminaire systems according to embodiments.
Figure 1B:
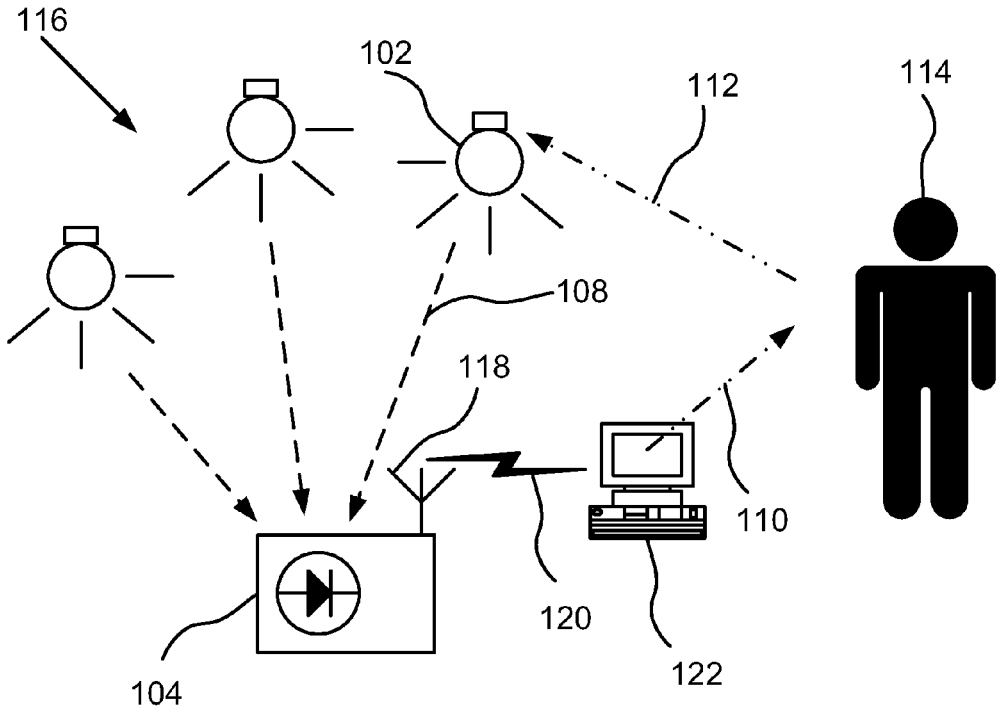
Figure 1C:
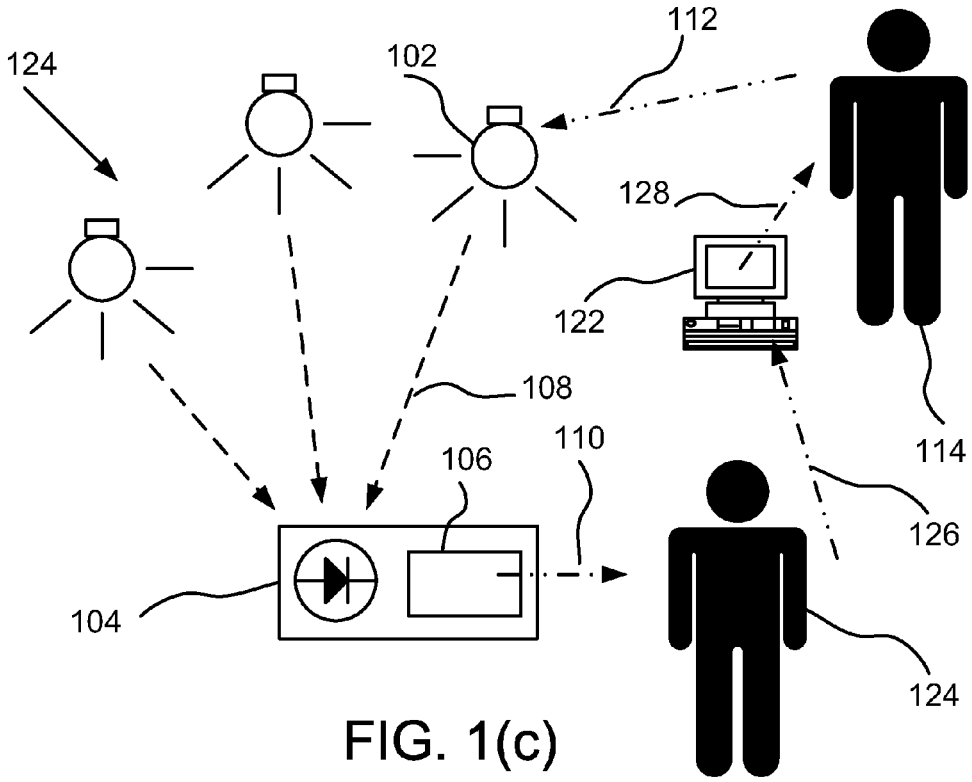
Figure 1D:
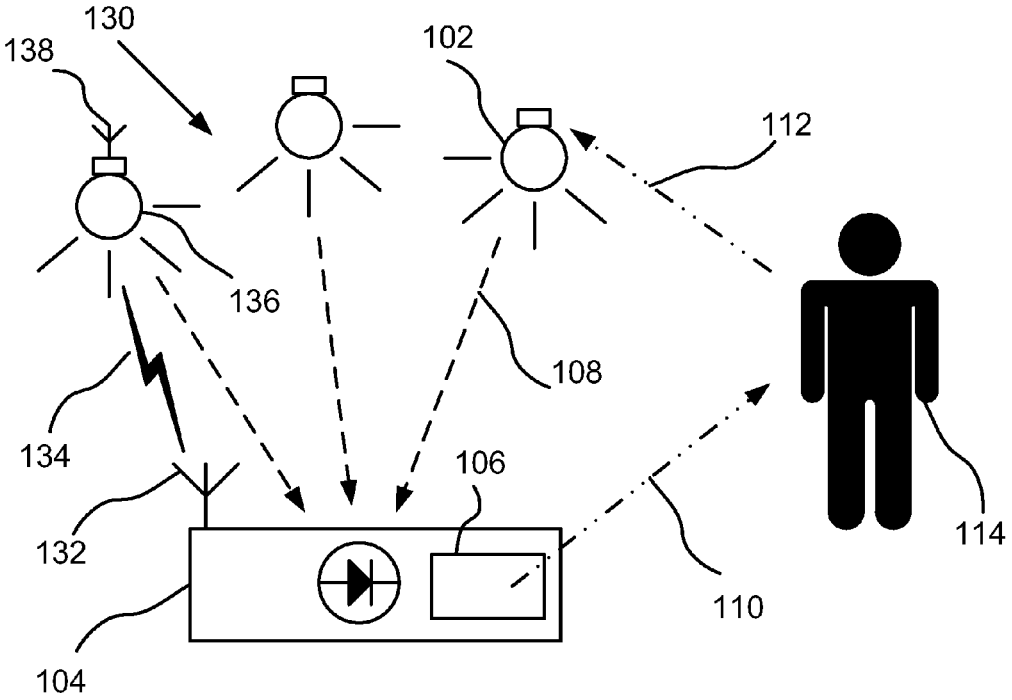
Figure 2A:
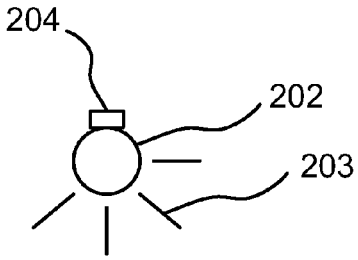
FIG. 2(*a*)-2(*b*) show a lighting device according to embodiments.
Figure 2B:
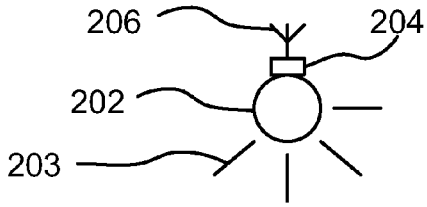
Figure 2C:
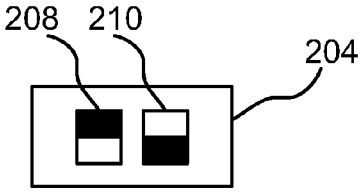
Figure 2D:
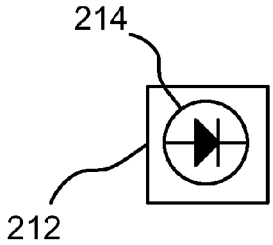
Figure 2E:
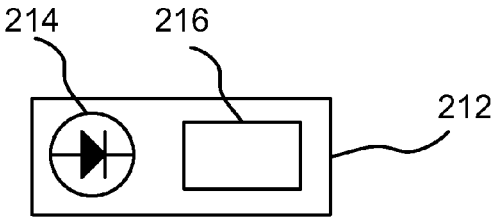
Figure 2F:
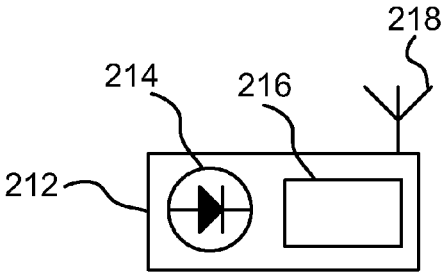

The present invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout.

FIG. 1(*a*) shows a luminaire system 100 in which the invention may readily apply. It should be noted that the term "luminaire" means a device that is used for providing light in a room, for purpose of illuminating objects in the room. Examples of such light providing devices include lighting devices and light sources. A room is in this context typically an apartment room or an office room, a gym hall, a room in a public place or a part of an outdoor environment, such as a part of a street. Accordingly, an luminaire is not, for example, a video projector or a backlight for a TV or a mobile phone.

The luminaire system 100 comprises at least one lighting device 102. Each lighting device 102, which may also be denoted as a light source, emits light. In the example of FIG. 1(*a*) the system 100 comprises three such lighting devices 102. For clarity reasons only one of the three lighting devices has been associated with a reference numeral in FIG. 1(*a*). Each lighting device 102 may further be associated with a number of lighting settings, e.g. colour, colour temperature and intensity of the emitted light. The lighting settings for each lighting device 102 in FIG. 1(*a*) may be manually adjusted by an operator 114.

The system further comprises an apparatus 104 for detecting the light emitted by the at least one lighting device 102. As will be discussed below with reference to FIG. 2(*d*)-(*f*) the apparatus is preferably arranged to comprise a light sensor 214 for detecting said light.

The system also comprises a user interface 106. In the embodiment as disclosed in FIG. 1(*a*) the user interface 106 is comprised in the apparatus 104, as marked by the dotted lines. However, as will be further discussed below, the user interface 106 may also be separated from the apparatus 106.

In the typical scenario of FIG. 1(*a*), the light sensor 214 of the apparatus 104 detects the light emitted by the one or more lighting device 102. The light comprises lighting data which may be associated with properties of the light, such as colour of the emitted light, the colour temperature of the emitted light and the intensity of the emitted light. The lighting data may further be associated with a unique lighting device identification code. For example such an identification code may be realized as a pulse width modulation code. As a second example the identification code may be realized by using code division multiple access techniques. It is to be understood that other embodiments for the realization of identification codes are known to a person skilled in the art.

The apparatus 104 is further arranged to identify an individual lighting device 102 from the group of said at least one lighting device 102. For example the sensor may be able to detect the physical direction from which the detected light is emanating. These physical directions are in FIG. 1(*a*) schematically denoted by arrows 108, which indicate the light emanating from the lighting devices 102. As a second example the individual lighting devices 102 may be identified by said lighting device identification codes, which, as discussed above, may be embedded in the emitted light contributions of the lighting devices 102. Since each individual lighting device 102 is associated with a unique lighting device identification code each individual lighting device 102 may be identified.

Lighting settings for the identified lighting device(s) 102 are then determined. As will be disclosed in more detailed next these settings are either determined by default settings or by comparing the received light with target lighting data.

According to one embodiment the identified lighting device(s) 102 are associated with default lighting settings. One exemplary situation of this scenario is the initial configuration of a newly installed lighting system. Default settings, as, say, determined by computer simulation, real-life measurements on the premises of installation, or other suitable premises, may then be directly presented to the operator for each identified lighting device(s). Thus for such an embodiment the lighting device(s) only need to be identified; lighting data concerning other parameters of the emitted light need not to be considered by the sensor 214.

According to one embodiment the light sensor 214 of the apparatus 104 may estimate the strength of the contributions of the different detected and identified lighting devices. The strength may for example pertain to the colour of the emitted light, the colour temperature of the emitted light and the intensity of the emitted light. The strength may pertain to one of these properties or a combination of several of these properties. By comparing these measurements with target lighting data, as defined by user inputs or standard settings, wherein the user input or standard settings pertain to, for example the required colour, colour temperature and/or intensity, lighting settings for the different lighting devices 102 may be determined. The target lighting data is thus associated with lighting data defining the detected light when pertaining to ideal settings.

The comparison may preferably be embodied by determining a relationship, such as calculating a difference, between the received light of the identified lighting device 102 and the target lighting data.

The determined lighting settings are then communicated to the operator 114 by presenting information via a user interface 106. In FIG. 1(*a*) this presentation is visualized by the arrow 110.

As will be further discussed in connection with FIG. 2(*e*)-2(*f*) the user interface 106 may comprise a display and/or a sound emitter. For example, if the user interface comprises a display the information may be presented as a combination of text and images on said display; if the user interface comprises a sound emitter, such as a loudspeaker, the information may be presented as a synthesized voice message.

Based on this presented information, the operator 114 can manually adjust the settings of the light device(s) 102 by manual interaction. In FIG. 1(*a*) the manual adjustment is visualized by the arrow 112.

This manual interaction can be performed in different ways. As a first example, the manual interaction may be accomplished by manually adjusting settings of a user interaction control interface, such as an actuator 204, comprised in the lighting device 102, e.g., by means of switching one or more DIP-switches (Dual In-line Package) or entering settings using a keypad of said lighting device 102. As is known to the skilled person such a DIP-switch may be designed to be used on a printed circuit board along with other electronic components and is commonly used to customize the behaviour of an electronic device for specific situations.

As a second example an external device may be inserted in, or connected to, the lighting device 102. The external device may have electrical or mechanical components, e.g. a resistor, with values corresponding to different settings of the lighting device 102. That is, consider a first and a second resistor associated with a first and a second resistor value, respectively. Consider further that the settings correspond to a first level and a second level, wherein the first level is lower than the second level. Assuming that the resistor value of the first resistor is larger than the resistor value of the second resistor; the first resistor corresponds to the lower value of the setting whilst the second resistor corresponds to the higher value of the setting. Thus the lower setting level may be chosen by inserting a device having the first resistor value, and vice versa.

The settings may also be manually adjusted by inserting, by an operator 114, a memory or programmable device in the lighting device 102, which has been programmed and/or has information stored on it as determined by the apparatus 104.

According to a further example the operator 114 may manually connect the apparatus 104 to the lighting device 102, e.g., by a serial or a USB (Universal Serial Bus) interface each time the lighting device 102 is to be provided with new settings.

For example, the apparatus 104 may in this case indicate to an operator when the new settings have been determined in order for the operator to know when he/she should manually connect the apparatus 104 to the lighting device 102 thereby enabling the new settings to be transmitted from the apparatus 104 to the lighting device 102. This indication may be realized by presenting an alert message via the user interface 106, by a sound signal or by a light signal provided by the apparatus 104.

A luminaire system 116 according to another embodiment in which the invention may readily apply is shown in FIG. 1(*b*). As in FIG. 1(*a*) the luminaire system 116 comprises one or more lighting devices 102 and an apparatus 104, and in which system 116 the one or more lighting devices 102 is/are manually adjustable by an operator 114. The exemplary luminaire system 116 of FIG. 1(*b*) furthermore comprises a portable external computer 122. The portable external computer 122 may be a laptop computer, a PDA (Portable Digital Assistant), or the like. As is known in the art such an external computer 110 comprises a controller suitable for performing various calculations and a user interface suitable for presenting information.

As in FIG. 1(*a*) the apparatus 104 advantageously comprises a light sensor which is capable of detecting light 108 from the at least one lighting devices 102. However, in contrast to the luminaire system 100 of FIG. 1(*a*) the detected lighting data is transmitted to the external computer 122.

In order to enable such a transmission the apparatus 104 is provided with a transmitter 118 and the external computer is provided with a receiver. The transmission 120 may either be wired or wireless using standard communication protocols such as e.g. Bluetooth (Bluetooth is a registered trademark), IEEE 802.11x, a USB connection, and so on as is known to the skilled person.

The controller of the external computer 122 may be arranged to identify an individual lighting device 102 from the group of said at least one lighting device 102, based in information provided by the sensor of the apparatus 104. The controller may further be arranged to compare the measured lighting data with target lighting data and thereby also determine lighting settings for the different lighting devices 102. It should however be noted that one or more of these steps may be comprised in the apparatus 104.

Thus the external computer 122 enables for using a powerful computation device for determining lighting settings for the lighting device(s) 102. This also means that the computing resources associated with the apparatus 104 may be significantly reduced.

The computed lighting settings may then be communicated to the operator 114 by presenting information via a user interface comprised in the external computer 122. In FIG. 1(*b*) this presentation is visualized by the arrow 110. Based on this presented information, the operator 114 can manually adjust the settings of the light devices by manual interaction. In FIG. 1(*b*) the manual adjustment is visualized by the arrow 112.

A suitable scenario might be a situation in which a laptop computer is brought by a lighting installer, or operator, for installation of the lighting system. After installation the laptop computer is no longer required in the system.

FIG. 1(*c*) shows another embodiment of a luminaire system 124. As in FIG. 1(*a*) the luminaire system 124 of FIG. 1(*c*) comprises at least one lighting device 102 and an apparatus 104, and in which system 124 the one or more lighting devices 102 is/are manually adjustable by an operator 114. In the luminaire system 124 of FIG. 1(*c*) the apparatus 104 comprises a user interface 106, realized as e.g. a display or a loudspeaker, which user interface 106 may present information to a first operator 124, wherein the information pertains to detected lighting data from the at least one lighting devices 102. This presentation is in FIG. 1(*c*) denoted by the arrow 110. As schematically denoted by the arrow 126, the lighting data, as presented via the user interface 106, may then be manually provided to the external computer 122 by the operator 124.

The controller of the external computer 122 may be arranged to identify an individual lighting device 102 from the group of said at least one lighting device 102, based in information provided by the sensor of the apparatus 104. The controller may further be arranged to compare the measured lighting data with target lighting data and thereby also determine lighting settings for the different lighting devices 102. It should however be noted that one or more of these steps may be comprised in the apparatus 104.

The computed lighting settings may then be communicated to the an operator 114 by presenting information via a user interface comprised in the external computer 122. In FIG. 1(*b*) this presentation is visualized by the arrow 128. Based on this presented information, the operator 114 can manually adjust the settings of the light devices by manual interaction. In FIG. 1(*c*) the manual adjustment is visualized by the arrow 112.

A luminaire system 124 according to such as scenario may thus handle the case when neither the apparatus 104 nor the external computer 122 comprises suitable communication interfaces. It may also be the case that both the apparatus 104 and the external computer 122 comprise communication means, but that a common communications protocol may not be deployed.

FIG. 1(*d*) shows another embodiment of a luminaire system 130. As in FIG. 1(*a*) the luminaire system 130 of FIG. 1(*d*) comprises at least one lighting device 102, 136 and an apparatus 104, and in which system 130 the at least one lighting device 102, 130 is/are manually adjustable by an operator 114. In the luminaire system 130 of FIG. 1(*d*) the apparatus 104 is provided with communication means 132, such as an antenna. Also, at least one 136 of the at least one lighting devices 102, 136 is provided with communication means 138, such as an antenna.

Communication between the apparatus 104 and the at least one devices 136 of the at least one lighting devices 102, 136 is thereby enabled. In the exemplary scenario as disclosed in FIG. 1(*d*) the apparatus 104 and the lighting device 136 have been provided with antennas, and the wireless communication between these entities has been indicated 134. However, note that the communication may also be wired.

As in FIG. 1(*a*) the apparatus 104 detects, identifies and determines lighting settings pertaining to the light emitted by the at least one lighting devices 102, 136. For the at least one 136 of the at least one lighting devices 102, 136 which is connected to the apparatus 104 the determined settings may be transferred directly and automatically to the connected lighting device 136. For the lighting device(s) 102 which are not operatively connected to the apparatus 104 the operator 114 manually adjusts the settings of the lighting devices 102 by any of the methods as discussed with references to FIG. 1(*a*)-(*c*).

FIG. 2(*a*) shows a lighting device 202, which may be one of the at least one lighting devices 102 of FIG. 1(*a*)-(*d*). The lighting device 202 emits light, as schematically indicated by the radiating lines 203. The emitted light comprises lighting data which may be associated with properties of the light, such as colour of the emitted light, the colour temperature of the emitted light and the intensity of the emitted light. The lighting data may further be associated with a unique lighting device identification code. Such an identification code may be realized as a pulse width modulation code or by using code division multiple access techniques. The lighting device 202 further comprises an actuator 204 for receiving manual user settings.

FIG. 2(*b*) shows a lighting device 202, as in FIG. 2(*a*), further comprising communication means 206, for enabling wired or wireless communications. For example the communication means 206 may be realized by an antenna, by a USB interface, or by a network interface.

FIG. 2(*c*) shows an actuator 204, such as the actuator 204 of the lighting device 202 of FIG. 2(*a*) or FIG. 2(*b*). In FIG. 2(*c*) the actuator 204 has been realized by two DIP-switches 208, 210. That is, by manually setting the DIP-switches 208, 210 the lighting device 202 may be manually adjusted.

FIG. 2(*d*) shows an apparatus 212, such as the apparatus 104 of FIG. 1(*a*). The apparatus 212 comprises a sensor 214, preferably a light sensor. Thus the sensor 214 is able to receive light emanating from at least one lighting device, such as the lighting device 202 of FIG. 2(*a*). As is known to the skilled person the sensor 214 transforms the incoming received light to electrical signals, which signals may then be transferred to a computing means for further analysis. Such a computing means, realized e.g. by a controller or by a processor, may be comprised in the apparatus 212. The further analysis may include comparing the measured incoming light with target lighting data, as defined by user inputs or standard settings and determining new lighting settings for the lighting device.

FIG. 2(*e*) shows an apparatus 212, as in FIG. 2(*d*), further comprising a user interface 216. Via such a user interface 216 the apparatus 212 may present information pertaining to the determined lighting settings. The user interface 216 may be realized by a display or by a loudspeaker.

FIG. 2(*f*) shows an apparatus 212, as in FIG. 2(*e*), further comprising communication means 218, for enabling wired or wireless communications with one or more lighting devices. For example the communication means 218 may be realized by an antenna, by a USB interface, or by a network interface.

Figure 3A:
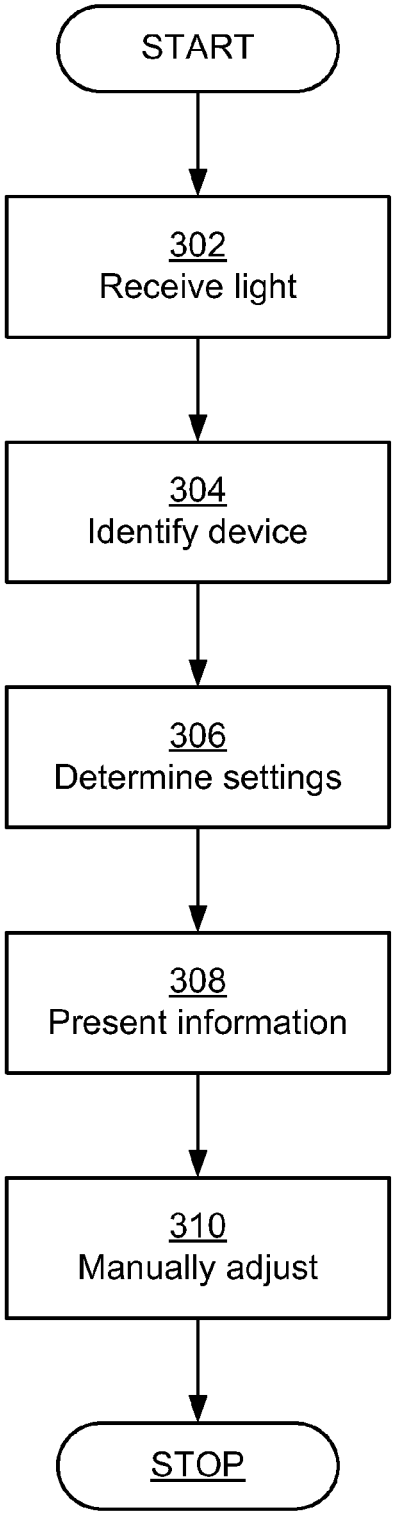
FIG. 3(*a*)-(*b*) show a flowchart for a method according to embodiments.
Figure 3B:
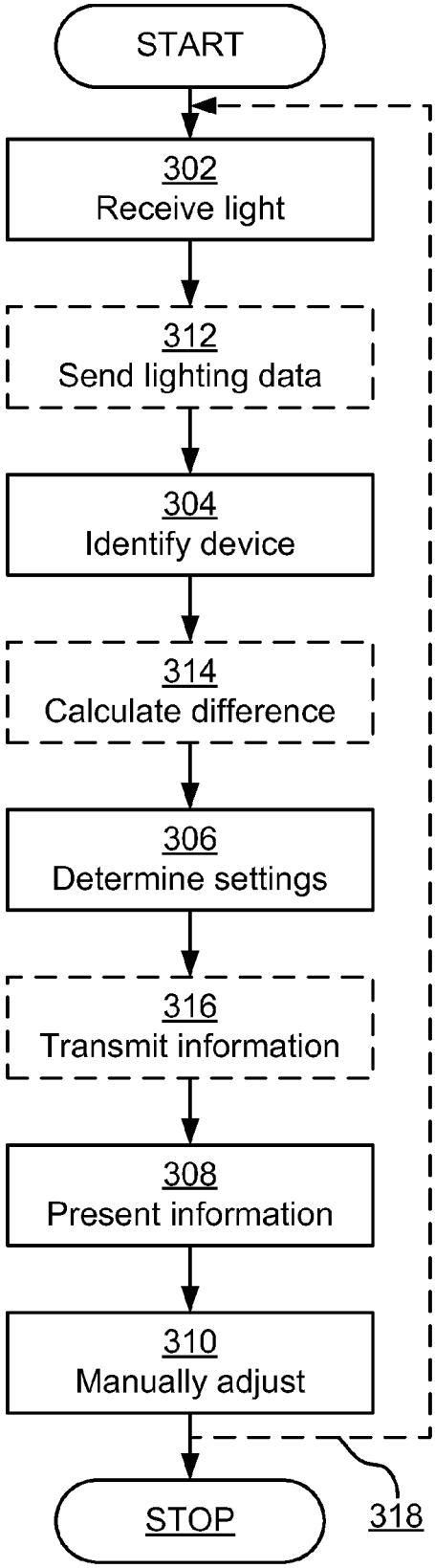

FIG. 3(*a*)-(*b*) shows flowcharts for a method of configuring a luminaire system as shown in FIG. 1(*a*)-(*d*) according to different embodiment. It is assumed that at least one lighting device 102, 136, 202, an apparatus 104, 212 comprising a light sensor 214 and a user interface 106, 216, have been provided and properly installed in the luminaire system. In a step 302 light 108 is received by the sensor from the at least one lighting device. The light comprises lighting data and the lighting data may comprise a lighting device identification code.

Using information contained in the lighting data the at least one lighting device can in a step 304 be identified. Lighting settings for the at least one identified lighting device are then determined in a step 306. The lighting settings may be default settings or the lighting settings may be determined based on the received lighting data; the lighting settings may pertain to at least one from the group of colour, colour temperature and intensity. In a step 308 information pertaining to the determined lighting settings is presented via the user interface. The user interface may be comprised in the apparatus or in an external computer.

The at least one identified lighting device may then be manually adjusted, by for example an operator, which observes and uses the presented information. The operator may manually adjust the at least one lighting device by manually adjusting at least one actuator of the at least one identified lighting device.

According to one embodiment the method may further comprise in a step 312 calculating a difference between the lighting data and target lighting data for the at least one identified lighting device. In this case the determining of lighting settings is based on the calculated difference.

The luminaire system may further comprises an external computer and the external computer may comprise the user interface. The method of configuring a luminaire system may then further comprise a step 314 of sending the lighting data from the apparatus to the external computer. The identifying, the calculating, the determining and the presenting may then be performed by the external computer.

The method may further comprise a step 316 of transmitting information pertaining to the determined lighting settings from the apparatus to the at least one identified lighting device by one from the group of a wireless transmission and a wired transmission.

According to one embodiment the method may further comprise iterating 318 at least the receiving light step 302, identifying step 304, the determining settings step 306, the presenting information step 308 and the manually adjusting step 310 during at least a first configuration iteration and a second configuration iteration. This iteration procedure may also include at least one of the steps of sending light data 314, calculating a difference 312 and transmitting information 316. In this embodiment identifiers may only be sent from the at least one lighting device after the operator has manually adjusted the settings during one iteration round.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method of configuring a luminaire system comprising at least one lighting device and an apparatus, said lighting device comprising at least one actuator, said apparatus comprising a light sensor and a user interface, said method comprising the steps of:

receiving, by said light sensor, light from said at least one lighting device, said light comprising lighting data;

identifying, by said apparatus, said at least one lighting device based on said lighting data;

determining, by said apparatus, lighting settings for said at least one identified lighting device;

receiving and presenting, by said user interface, information pertaining to said determined lighting settings; and receiving, by said at least one actuator, manual adjustment of said at least one identified lighting device based on said presented information.

2. The method according to claim 1 further comprising the step of:

calculating, by said apparatus, a difference between said lighting data and target lighting data for said at least one identified lighting device; and wherein said determining lighting settings is based on said difference.

3. The method according to claim 1, wherein said lighting settings pertain to at least one from the group of colour, colour temperature, intensity.

4. The method according to claim 1, wherein the steps of receiving light, identifying at least one lighting device, determining lighting settings, receiving and presenting information and receiving manual adjustment are performed during at least a first configuration iteration and a second configuration iteration.

5. A computer program product, comprising computer program code which is stored on a computer-readable storage medium and which, when executed on a processor, carries out the method according to claim 1.

6. The method according to claim 1, further comprising the step of:

transmitting, by said apparatus, information pertaining to said determined lighting settings from said apparatus to said at least one identified lighting device by one from the group of a wireless transmission and a wired transmission.

7. The method according to claim 1, wherein said lighting data comprises a lighting device identification code.

8. A luminaire system comprising at least one lighting device and an apparatus, said lighting device comprising at least one actuator, said apparatus comprising a light sensor (214) and a user interface, wherein:

said light sensor is arranged to receive light from said at least one lighting device, said light comprising lighting data;

said apparatus is arranged to identify said at least one lighting device based on said received lighting data;

said apparatus is arranged to determine lighting settings for said at least one identified lighting device;

said user interface is arranged to receive and present information pertaining to said determined lighting settings; and said at least one identified lighting device is arranged to, via said at least one actuator be manually adjusted based on said presented information.

9. The luminaire system according to claim 8, wherein at least one of said at least one lighting device comprises a receiver, wherein said apparatus further comprises a transmitter, and wherein information pertaining to said determined lighting settings is transmitted by said transmitter to said receiver(s) by one from the group of a wireless transmission and a wired transmission.

10. The luminaire system according to claim 8, wherein said at least one lighting device does not comprise any communication means for automatically receiving determined lighting settings.

11. The luminaire system according to claim 8, wherein:

a difference between said received lighting data and target lighting data for said at least one identified lighting device is calculated; and wherein lighting settings are based on said difference.

12. An apparatus for configuration of a luminaire system, said apparatus comprising a light sensor a controller, and a user interface wherein light from at least one lighting device is received by said light sensor, said light comprising lighting data;

said at least one lighting device is identified by said controller based on said received lighting data;

lighting settings for said at least one identified lighting device are determined by said controller; and said user interface is arranged to receive and present information pertaining to said determined lighting settings.

13. The apparatus according to claim 12, wherein a difference between said received lighting data and target lighting data for said at least one identified lighting device is calculated by said controller; and wherein said lighting settings are based on said difference.

14. The apparatus according to claim 12 further comprising a transmitter, and wherein information pertaining to said determined lighting settings is transmitted by said transmitter to at least one of said at least one lighting device by one from the group of a wireless transmission and a wired transmission.

* * * * *